US009300067B2

(12) United States Patent
Yokoo

(10) Patent No.: US 9,300,067 B2
(45) Date of Patent: Mar. 29, 2016

(54) CONNECTOR

(71) Applicant: Japan Aviation Electronics Industry, Limited, Tokyo (JP)

(72) Inventor: Hiroyuki Yokoo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/493,467

(22) Filed: Sep. 23, 2014

(65) Prior Publication Data

US 2015/0118909 A1 Apr. 30, 2015

(30) Foreign Application Priority Data

Oct. 25, 2013 (JP) ..... 2013-221730

(51) Int. Cl.
*H01R 12/88* (2011.01)
*H01R 12/77* (2011.01)
*H01R 12/79* (2011.01)

(52) U.S. Cl.
CPC ..... *H01R 12/88* (2013.01); *H01R 12/775* (2013.01); *H01R 12/79* (2013.01)

(58) Field of Classification Search
CPC ..... H01R 23/684; H01R 23/6873; H01R 23/658; H01R 23/662; H01R 12/79; H01R 13/658; H01R 23/668; H01R 13/62983; H01R 13/62994; H01R 12/88; H01R 12/775
See application file for complete search history.

(56) References Cited

U.S. PATENT DOCUMENTS 5,373,109 A * 12/1994 Argyrakis ..... H01R 12/78 174/117 F
5,387,125 A * 2/1995 Davis ..... H01R 12/775 439/497
6,645,002 B1 * 11/2003 Lee ..... H01R 4/2429 439/404
6,755,687 B1 * 6/2004 Ko ..... H01R 4/024 439/579
6,932,648 B1 * 8/2005 Chiu ..... H01R 13/65802 439/492
7,261,595 B2 * 8/2007 Shino ..... H01R 12/775 439/607.49

(Continued)

FOREIGN PATENT DOCUMENTS

JP 2006-179192 A 7/2006
JP 2009-272256 A 11/2009

(Continued)

OTHER PUBLICATIONS

Korean Office Action dated Nov. 24, 2015 in Korean Application No. 10-2014-0133086 with English translation.

*Primary Examiner* — Gary Paumen
(74) *Attorney, Agent, or Firm* — Collard & Roe, P.C.

(57) ABSTRACT

A connector has a receiving portion which is receivable a connection member inserted rearward in a front-rear direction. The connection member has a plate-like or sheet-like shape and has terminals and a ground pattern. The connector comprises a plurality of contacts, a holding member and a conductive member. The contacts have contact points, respectively. The contact points are to be in contact with the terminals, respectively. The holding member holds the contacts. The conductive member is attached to the holding member. The conductive member has a shield connection portion which is to be in contact with the ground pattern. The shield connection portion is positioned frontward of the contact points of the contacts in the front-rear direction and is positioned outward of the contact points in a width direction perpendicular to the front-rear direction.

12 Claims, 10 Drawing Sheets

(56) References Cited

U.S. PATENT DOCUMENTS

| | | | | |
|---|---|---|---|---|
| 7,354,300 | B2 * | 4/2008 | Shindo | H01R 13/648 439/497 |
| 8,083,542 | B2 * | 12/2011 | Kodaira | H01R 12/594 439/497 |
| 8,241,065 | B2 * | 8/2012 | Ikari | H01R 12/775 439/372 |
| 8,814,594 | B2 * | 8/2014 | Miyazaki | H01R 12/55 439/260 |
| 8,858,249 | B2 * | 10/2014 | Honda | H01R 13/648 439/260 |
| 2006/0160421 | A1 * | 7/2006 | Dangler | H05K 1/0218 439/607.01 |
| 2008/0185167 | A1 * | 8/2008 | Lee | H01B 7/0823 174/117 F |
| 2008/0236868 | A1 * | 10/2008 | Koga | H01B 7/0861 174/117 F |
| 2009/0203261 | A1 * | 8/2009 | Ikegami | H01R 12/775 439/628 |
| 2009/0221178 | A1 * | 9/2009 | Hirata | H01R 12/88 439/497 |
| 2010/0062647 | A1 * | 3/2010 | Yang | H01R 13/701 439/630 |
| 2010/0110056 | A1 * | 5/2010 | Kim | H01R 12/722 345/211 |
| 2010/0216342 | A1 * | 8/2010 | Lin | H01R 4/023 439/607.49 |
| 2011/0151682 | A1 * | 6/2011 | Kodaira | H01R 12/594 439/55 |
| 2011/0237101 | A1 * | 9/2011 | Yang | H01R 12/737 439/153 |
| 2012/0045930 | A1 * | 2/2012 | Ueda | H01R 12/79 439/497 |

FOREIGN PATENT DOCUMENTS

| | | | |
|---|---|---|---|
| JP | 2010-267498 | A | 11/2010 |
| JP | 2013-101798 | A | 5/2013 |
| KR | 10-2011-0132821 | A | 12/2011 |

* cited by examiner

CONNECTOR

CROSS REFERENCE TO RELATED APPLICATIONS

An applicant claims priority under 35 U.S.C. §119 of Japanese Patent Application No. JP2013-221730 filed Oct. 25, 2013.

BACKGROUND OF THE INVENTION

This invention relates to a connector configured to be connected to a connection member having a plate-like or sheet-like shape such as a Flexible Printed Circuit (FPC) or a Flexible flat Cable (FFC).

A connector of this type is disclosed in JP-A 2013-101798 (Patent Document 1). As shown in FIG. 19, the connector 100 of Patent Document 1 is connected to a platy cable (connection member) 101 having a special shape. The connection member 101 of Patent Document 1 has terminals and engaged portions 102. The terminals are to be in contact with contacts 103 of the connector 100, respectively. The engaged portions 102 project outward in a width direction. Thus, the connection member 101 of Patent Document 1 has a T-like shape. The engaged portions 102 are positioned outward of the terminals in the width direction. On the other hand, the engaged portions 102 and the terminals are at the same position in a front-rear direction. The connector 100 of Patent Document 1 is provided with portions 104 which are positioned frontward of the engaged portions 102 and prevent the engaged portions 102 from coming off the connector 100.

The connector of Patent Document 1 can be connected only to the aforementioned connection member having the T-like shape. In other words, the connector of Patent Document 1 cannot be connected to an ordinary belt-like connection member such as an FPC. Thus, the connector of Patent Document 1 has a problem that the connector is not versatile.

In recent years, there is a connection member which has a ground pattern in order to correspond to a high-speed signal transmission. If the connector of Patent Document 1 is provided with a connection portion which is to be in contact with the ground pattern, enlargement of the connector of Patent Document 1 cannot be avoided due to its structure.

SUMMARY OF THE INVENTION

It is therefore an object of the present invention to provide a connector which suppresses enlargement of the connector and is connectable to either a connection member (FPC or FFC) having a ground pattern or an ordinary connection member (FPC or FFC).

One aspect of the present invention provides a connector having a receiving portion which is receivable a connection member inserted rearward in a front-rear direction. The connection member has a plate-like or sheet-like shape and has terminals and a ground pattern. The connector comprises a plurality of contacts, a holding member and a conductive member. The contacts have contact points, respectively. The contact points are to be in contact with the terminals, respectively. The holding member holds the contacts. The conductive member is attached to the holding member. The conductive member has a shield connection portion which is to be in contact with the ground pattern. The shield connection portion is positioned frontward of the contact points of the contacts in the front-rear direction and is positioned outward of the contact points in a width direction perpendicular to the front-rear direction.

The shield connection portion is in contact with the ground pattern of the connection member. The shield connection portion is positioned frontward of the contact points of the contacts. The shield connection portion is positioned outward in the width direction of the contact points. Accordingly, the connector can be provided with the shield connection portion without enlargement of the connector.

In addition, the shield connection portion is positioned outward of an ordinary belt-like connection member such as an FPC or the like in the width direction. Thus, a connection between the connector and the ordinary-shaped connection member is not obstructed by the shield connection member.

An appreciation of the objectives of the present invention and a more complete understanding of its structure may be had by studying the following description of the preferred embodiment and by referring to the accompanying drawings.

Figure 1:
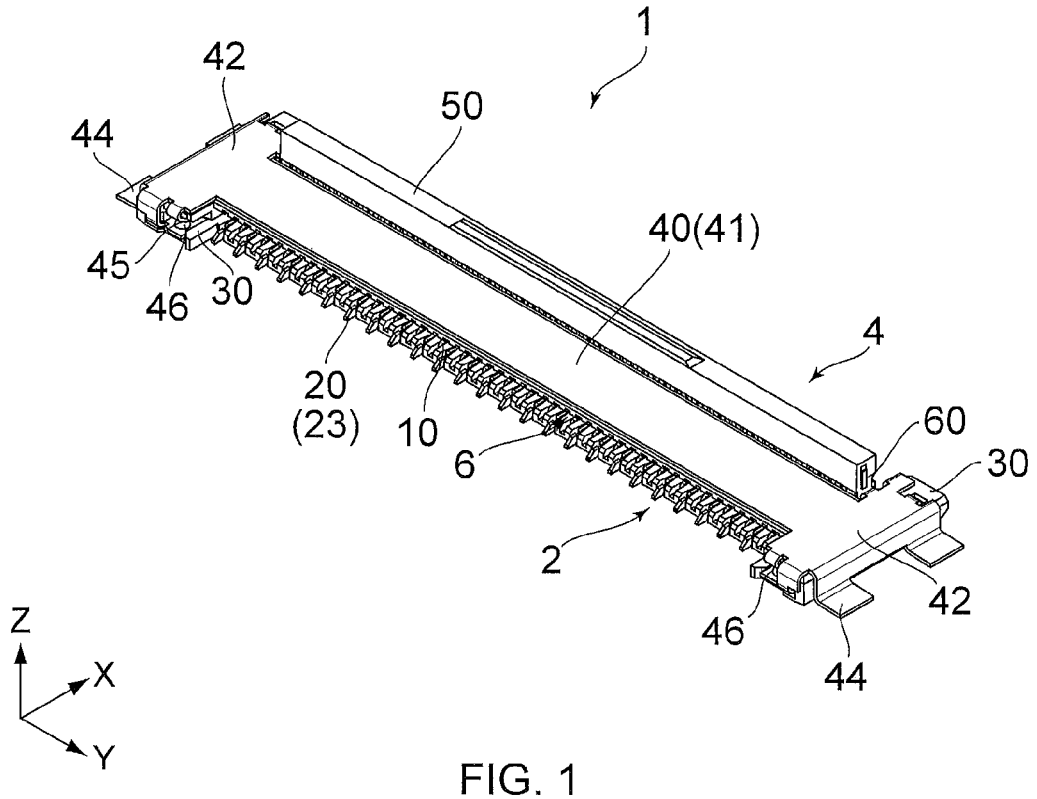
FIG. 1 is a front, perspective view showing a connector according to an embodiment of the present invention. An actuator included in the connector is under an open state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 7, a connector 1 according to an embodiment of the present invention has a receiving portion 6 which opens at a front end 2 positioned frontward (in a negative X-direction) of the connector 1. The receiving portion 6 is receivable an end of an FPC (connection member) which is inserted rearward (in a positive X-direction) in a front-rear direction (in the X-direction). The connection member is described later. A rear end 4 is positioned rearward of the connector 1. The connector 1 comprises first contacts (contacts) 10, second contacts (contacts) 20, a holding member 30, a shell (conductive member) 40, an actuator 50 and a shield member 60. The first contacts 10, the second contacts 20, the shell 40 and the shield member 60 are made of conductor. The holding member 30 and the actuator 50 are made of insulator.

Figure 17:
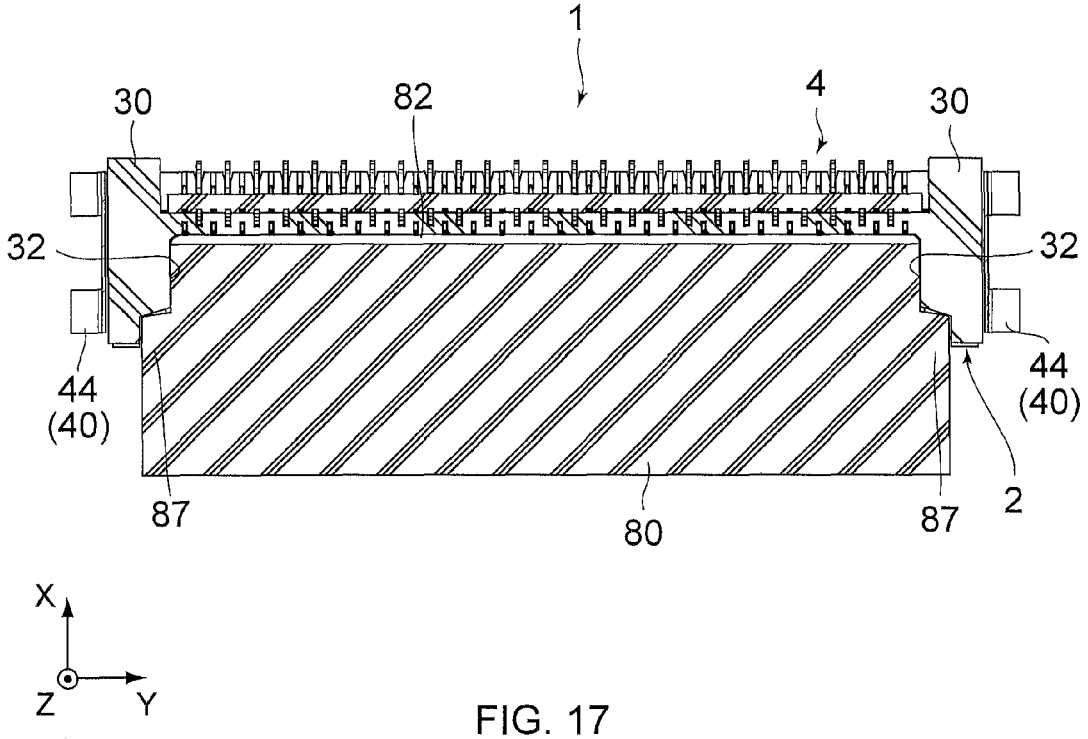
FIG. 17 is a cross-sectional view showing a state where the FPC of FIG. 14 is connected to the connector of FIG. 5.
Figure 18:
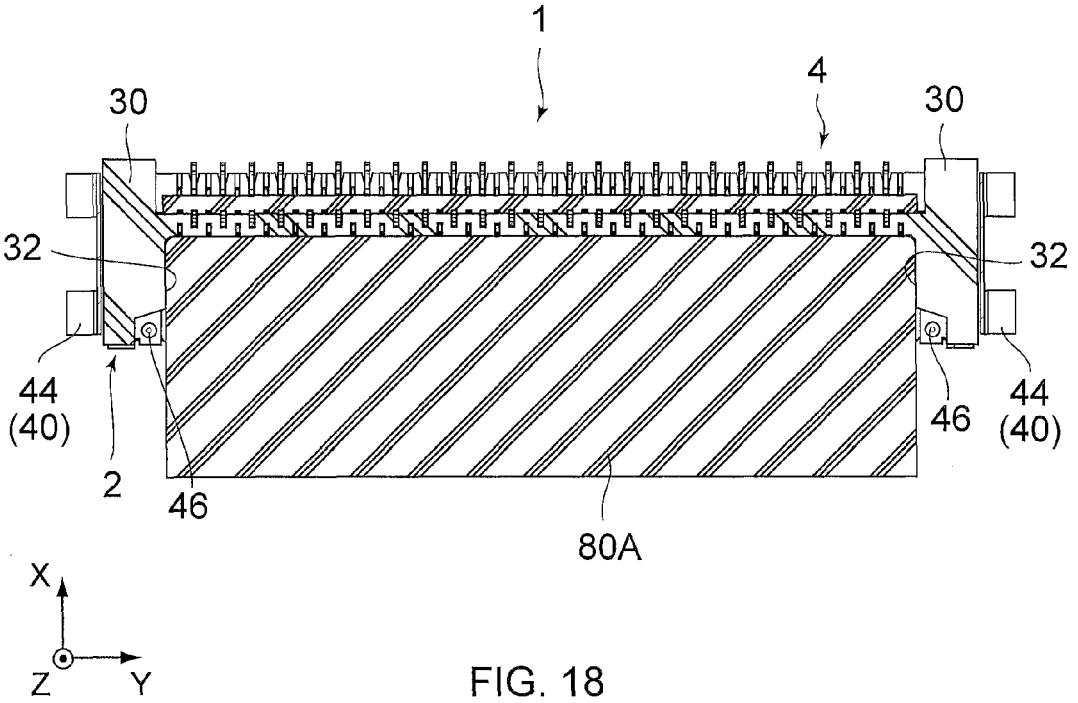
FIG. 18 is a cross-sectional view showing a state where an ordinary FPC is connected to the connector of FIG. 5.
Figure 19:
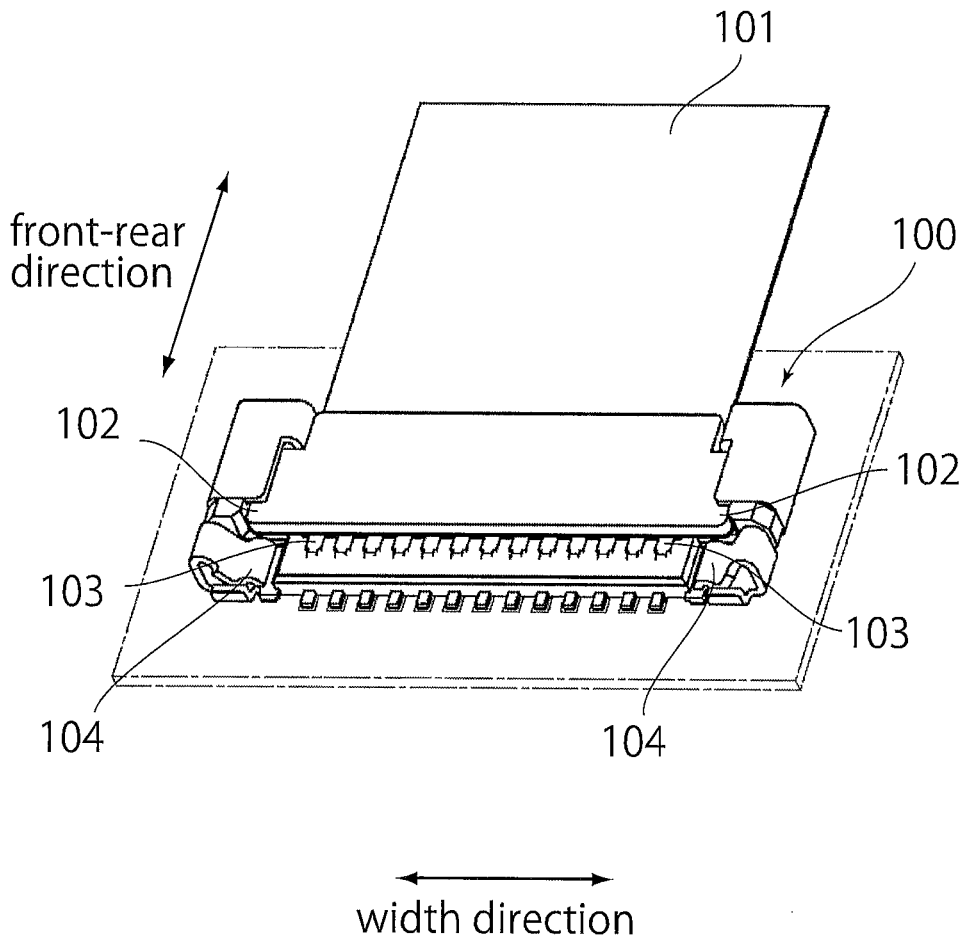
FIG. 19 PRIOR ART
FIG. 19 is a perspective view showing a connector of Patent Document 1.

In detail, as shown in FIG. 17, the connector 1 according to the present embodiment is connectable with a special FPC (connection member) 80. As shown in FIG. 18, the connector 1 is connectable with an ordinary FPC 80A having a belt-like shape, too. In addition, the ordinary FPC 80A may or may not have a ground pattern.

Figure 14:
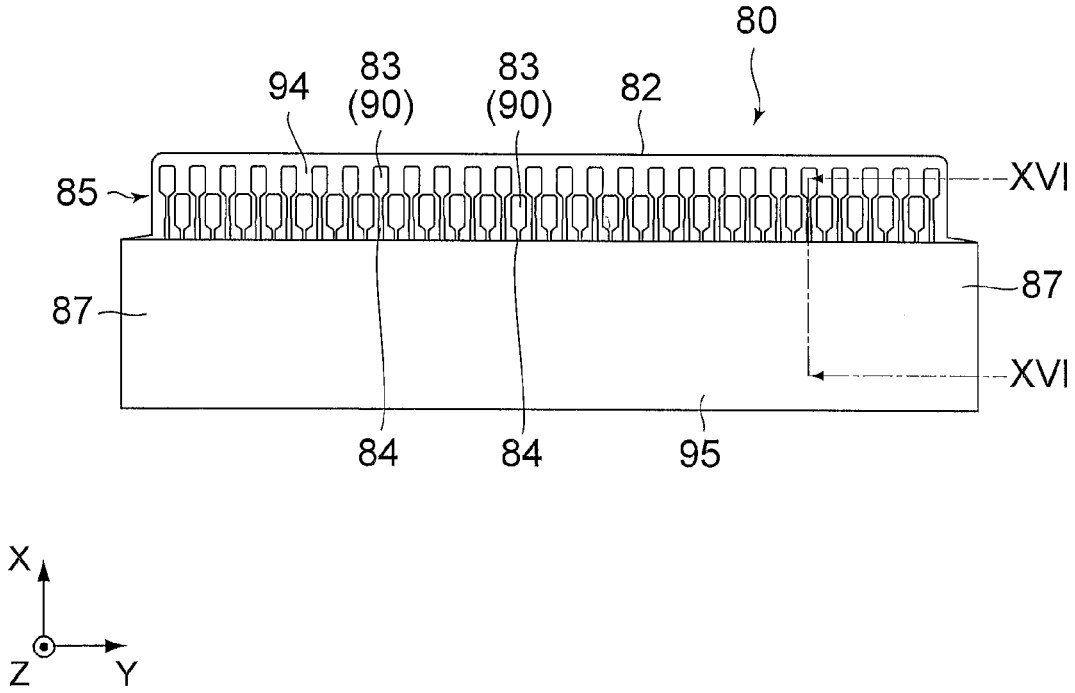
FIG. 14 is a top view showing an FPC (connection member) which is connected to the connector of FIG. 1.
Figure 15:
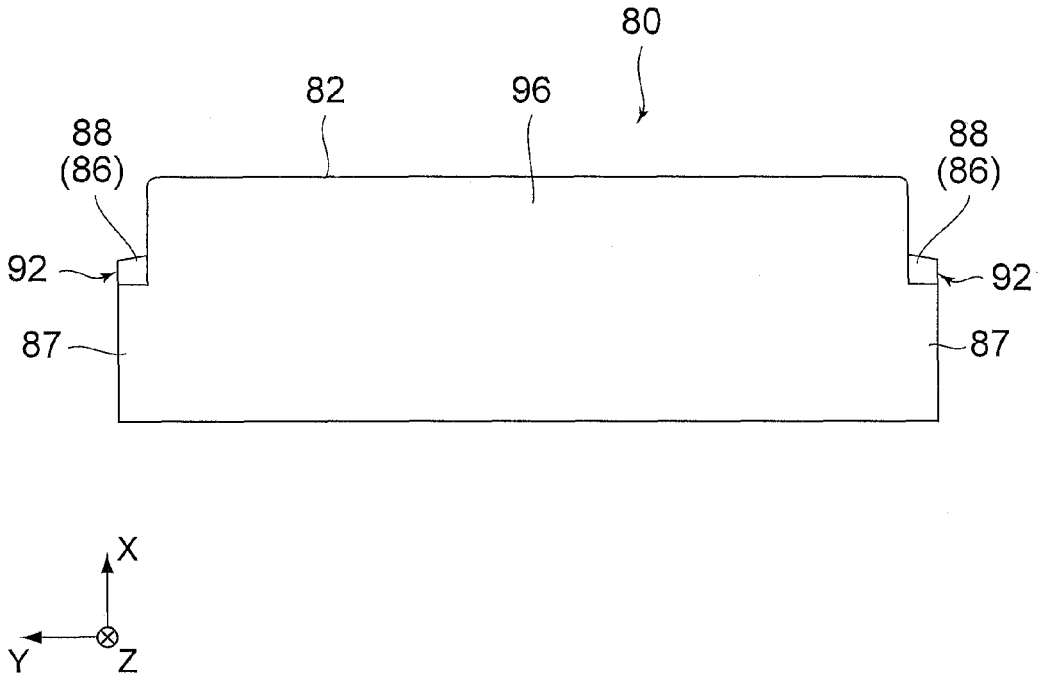
FIG. 15 is a bottom view showing the FPC of FIG. 14.
Figure 16:
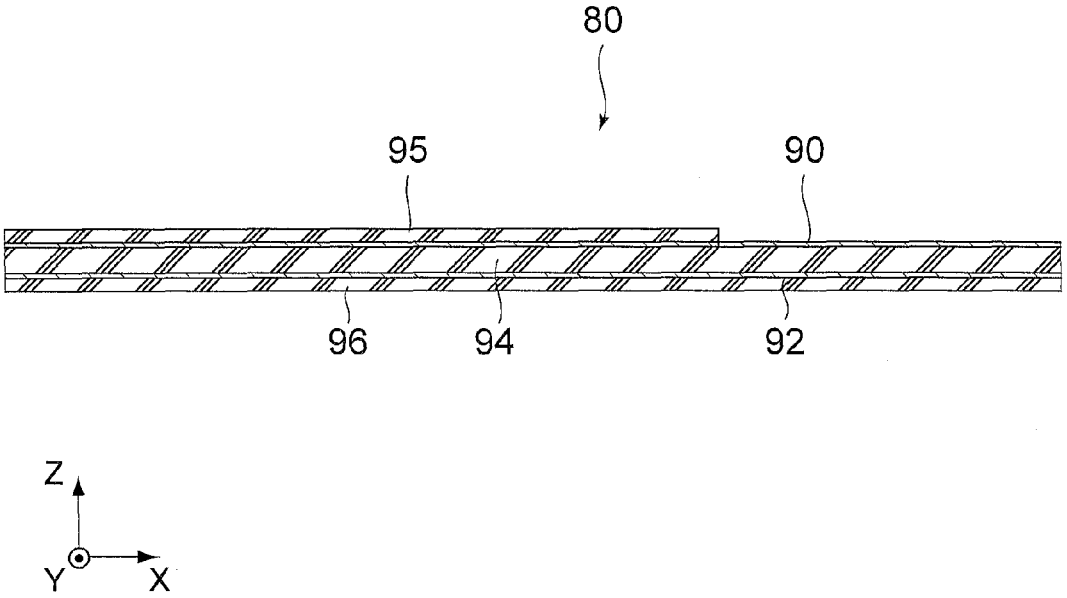
FIG. 16 is a cross-sectional view showing a part of the FPC of FIG. 14, taken along line XVI-XVI.

Referring to FIGS. 14 to 16, the special FPC 80 according to the present embodiment comprises a signal layer 90, a ground layer 92, a first insulation layer 94, a second insulation layer 95 and a third insulation layer 96. The first insulation layer 94 is sandwiched between the signal layer 90 and the ground layer 92. The signal layer 90 is sandwiched between the first insulation layer 94 and the second insulation layer 95. The ground layer 92 is sandwiched between the first insulation layer 94 and the third insulation layer 96. The signal layer 90 is formed with a plurality of terminals 83 and a plurality of signal lines 84, respectively. The terminals 83 are positioned closer to an end 82 than the signal lines 84, respectively. In other words, a distance between the terminals 83 and the end 82 is shorter than another distance between the signal lines 84 and the end 82. The signal lines 84 extend from the terminals 83, respectively. The ground layer 92 is formed by a ground pattern 86 made of a uniform conductive film. As described later, parts of the ground pattern 86 are exposed as exposed portions 88, respectively.

As shown in FIG. 14, the end 82 of the FPC 80 is provided with a terminal exposed region 85 on which the terminals 83 are arranged. In the present embodiment, the terminals 83 are grouped into two groups: a group of the terminals 83 which are to be in contact with the first contacts 10, respectively; and a group of the terminals 83 which are to be in contact with the second contacts 20, respectively. The terminals 83 for the first contacts 10 and the terminals 83 for the second contacts 20 are alternately arranged in a width direction (in a Y-direction) and in a lengthwise direction (in the X-direction) of the FPC 80.

As shown in FIGS. 14 and 15, the FPC 80 has projection portions 87 which are positioned apart from the end 82 in the lengthwise direction. As understood from FIG. 14, each of the projection portions 87 is farther apart from the end 82 than the terminal exposed region 85. In other words, the terminal exposed region 85 is positioned between the end 82 and the projection portions 87. In addition, each of the projection portions 87 projects outward in the width direction of the FPC 80. Accordingly, a part including the projection portions 87 is wider than the terminal exposed region 85 in the width direction.

As shown in FIG. 15, ends of the projection portions 87 are formed with the exposed portions 88, respectively. In the present embodiment, a surface on which the exposed portions 88 are formed on a surface which is a back of another surface on which the terminal exposed region 85 is formed. However, the present invention is not limited thereto. The exposed portions 88 may be formed on a surface on which the terminal exposed region 85 is also formed. The ground pattern 86 is exposed on the exposed portions 88. The exposed portions 88 are positioned farther apart from the end 82 of the FPC 80 than the terminals 83 in the lengthwise direction and are positioned outward of the terminals 83 in the width direction of the FPC 80.

Figure 6:
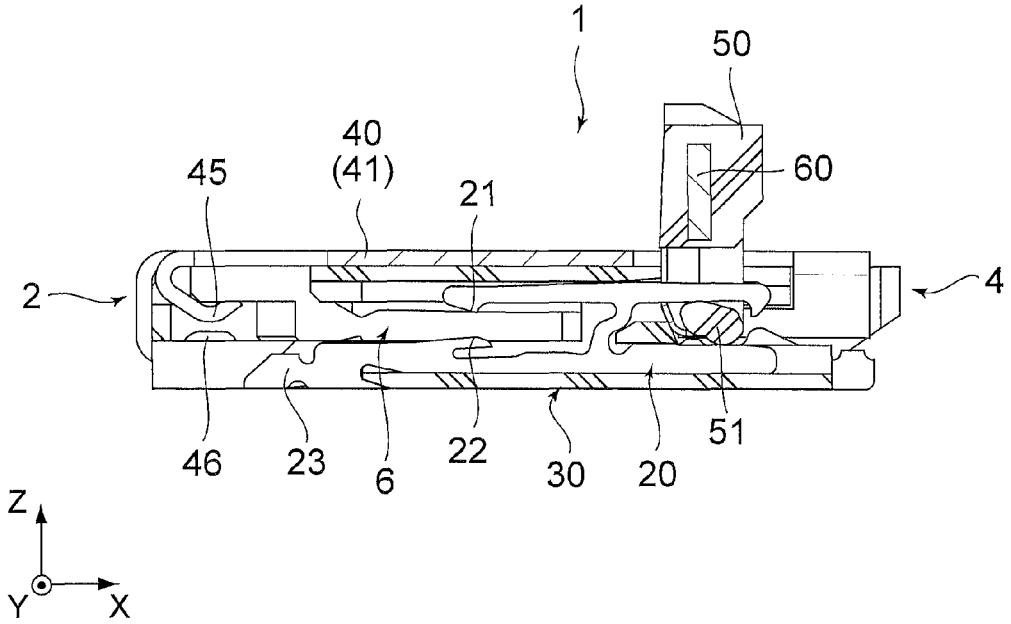
FIG. 6 is a cross-sectional view showing the connector of FIG. 4, taken along line VI-VI.
Figure 7:
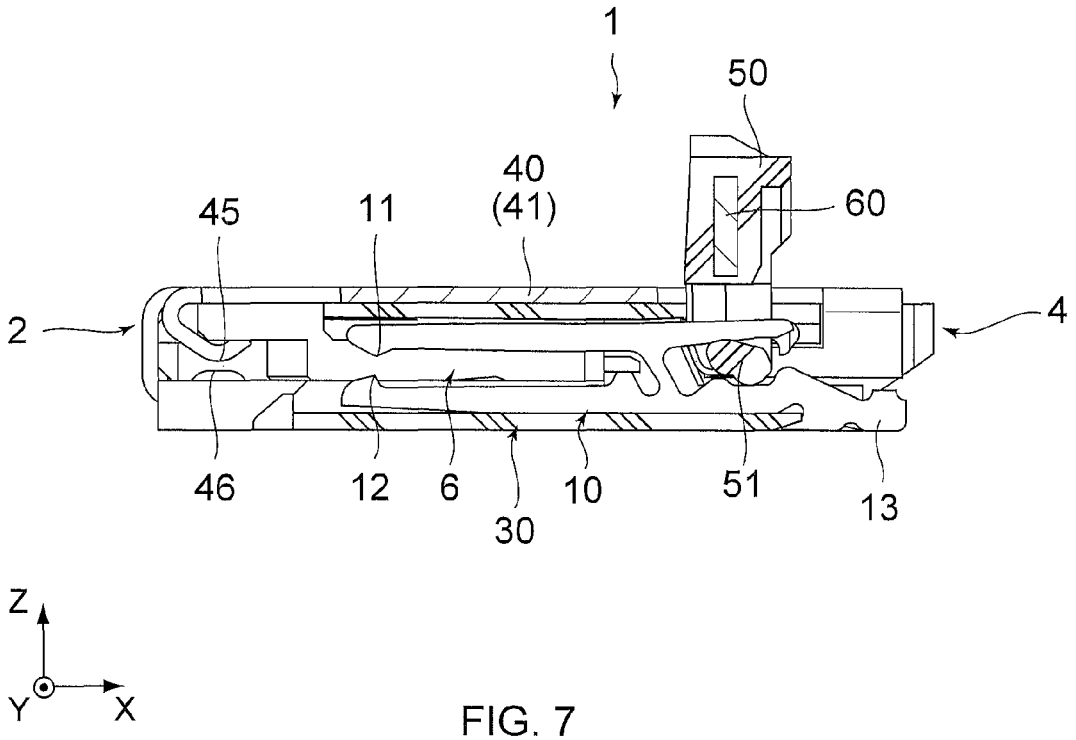
FIG. 7 is a cross-sectional view showing the connector of FIG. 4, taken along line VII-VII.

As understood from FIGS. 6 and 7, the holding member 30 holds the first contacts 10 and the second contacts 20. As shown in FIG. 7, each first contact 10 has an upper contact point (contact point) 11, a lower contact point (contact point) 12 and a fixed portion 13. The upper contact point 11 and the lower contact point 12 are positioned in the receiving portion 6. The upper contact point 11 faces the lower contact point 12 in an up-down direction (in a Z-direction). The fixed portion 13 of the first contact 10 is positioned toward the rear end 4 of the connector 1. As shown in FIG. 6, each second contact 20 has an upper contact point (contact point) 21, a lower contact point (contact point) 22 and a fixed portion 23. The upper contact point 21 and the lower contact point 22 are positioned in the receiving portion 6. The upper contact point 21 faces the lower contact point 22 in the up-down direction (in the Z-direction). The fixed portion 23 of the second contact 20 is positioned toward the front end 2 of the connector 1. Thus, the first contact 10 has the fixed portion 13 positioned toward the rear end 4 (positive X-side end) while the second contact 20 has the fixed portion 13 positioned toward the front end 2 (negative X-side end). In other words, the first contact 10 has the fixed portion 13 positioned rearward of the upper contact point 11 and the lower contact point 12 while the second contact 20 has the fixed portion 23 positioned frontward of the upper contact point 21 and the lower contact point 22. The second contact 20 is also referred to as a front contact. With reference also with FIG. 14, when the FPC 80 is inserted into the receiving portion 6 so that the terminals 83 face upward, the terminals 83 are in contact with the upper contact points 11, 21, respectively. On the other hand, when the FPC 80 is inserted into the receiving portion 6 so that the terminals 83 face downward, the terminals 83 are in contact with the lower contact points 12, 22, respectively. Thus, in the present embodiment, if the FPC 80 is reversely inserted into the connector 1, the FPC 80 is connectable to the connector 1.

Figure 5:
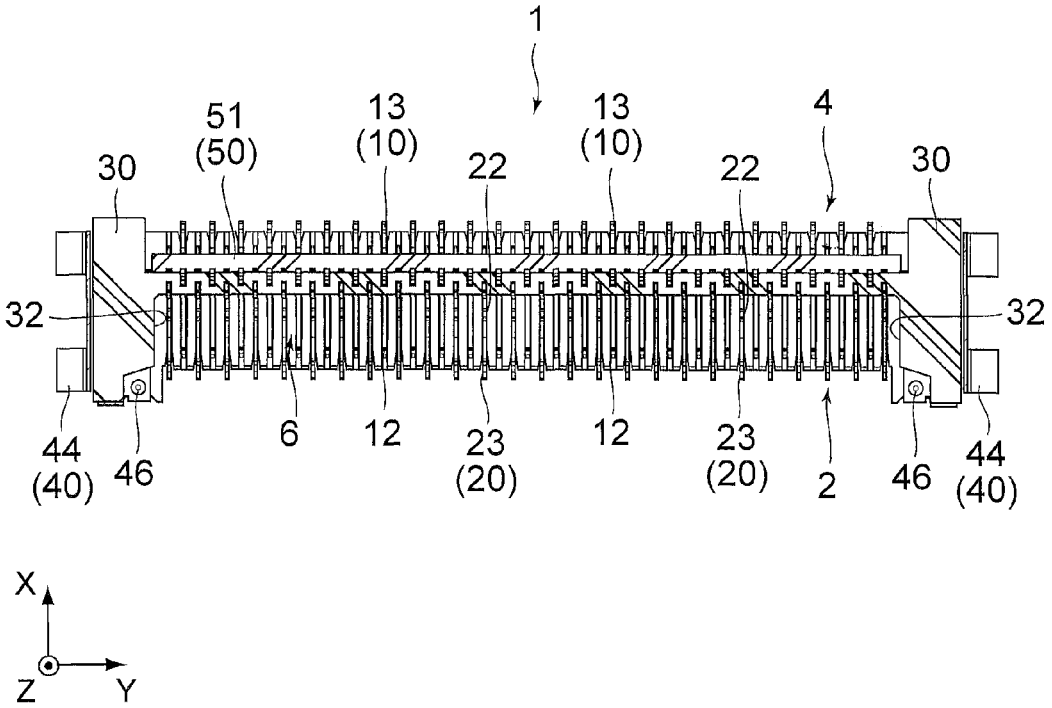
FIG. 5 is a cross-sectional view showing the connector of FIG. 4, taken along line V—V.

As shown in FIG. 5, the holding member 30 is provided with rotation preventing portions 32. Each of the rotation preventing portions 32 forms a sidewall of the receiving portion 6. Specifically, the rotation preventing portion 32 is positioned outward of the upper contact points 11, 21 and the lower contact points 12, 22 in the width direction. Especially, in the present embodiment, a distance between the rotation preventing portions 32 is slightly larger than a size (width) of the terminal exposed region 85 of the FPC 80 in the width direction. As understood from FIGS. 5 and 17, when the FPC 80 is inserted into the receiving portion 6, the FPC 80 is substantially restricted to be movable only in the front-rear direction in a horizontal plane (XY-plane) so that the FPC 80 is prevented from being rotated in the horizontal plane.

Figure 12:
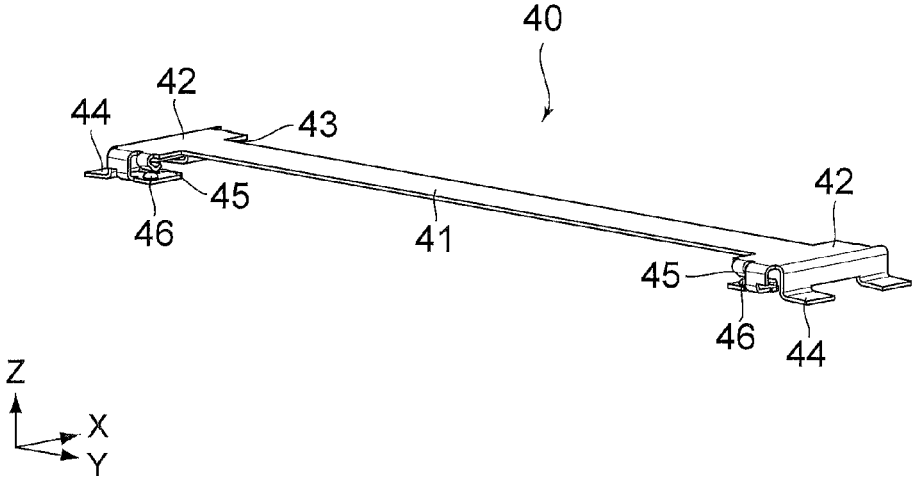
FIG. 12 is a front, perspective view showing a shell included in the connector of FIG. 1.
Figure 13:
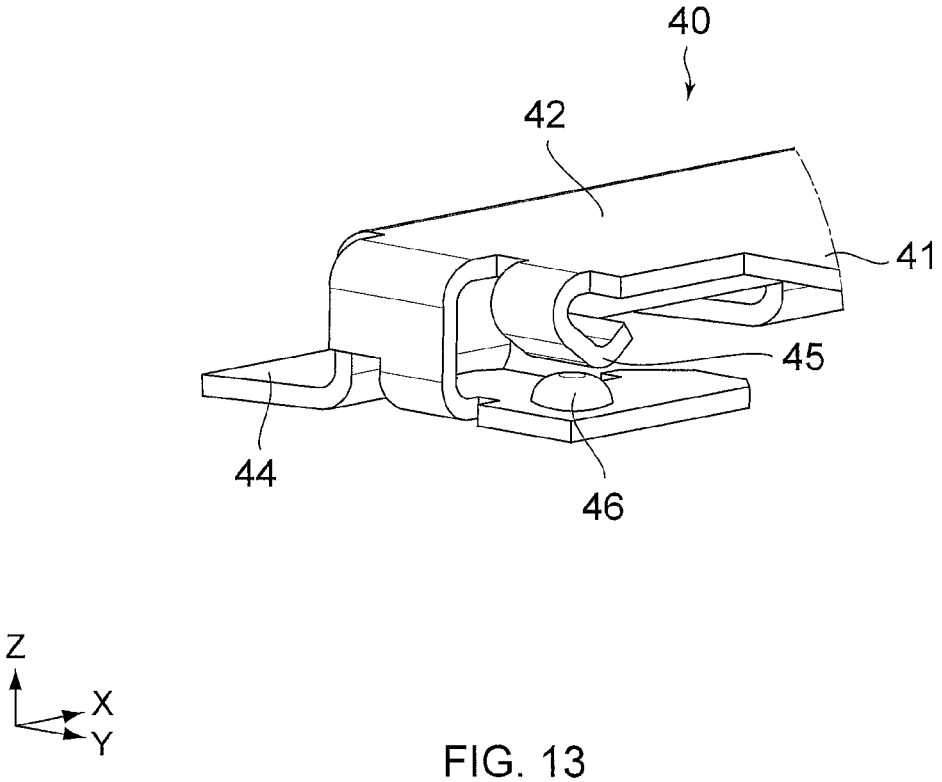
FIG. 13 is an enlarged view showing a part of the shell of FIG. 12.

As shown in FIGS. 12 and 13, the shell 40 has a main plate portion 41, two side portions 42, two shell connection portions 43, four holddowns 44, two upper connection portions (shield connection portions) 45 and two lower connection portions (shield connection portions) 46.

The main plate portion 41 covers almost all the holding member 30. As understood from FIGS. 1, 2 and 5, the fixed portions 13 of the first contacts 10 are positioned rearward of the main plate portion 41 while the fixed portions 23 of the second contacts 20 are positioned frontward of the main plate portion 41. In a state where the FPC 80 is not connected to the connector 1, the fixed portions 23 of the second contacts 20 are visible from above the connector 1. In other words, the fixed portions 23 of the front contacts are visible from above. Accordingly, when the connector 1 is mounted and fixed on an object (not shown), connection states of the fixed portions 23 to the object can be easily confirmed.

Figure 9:
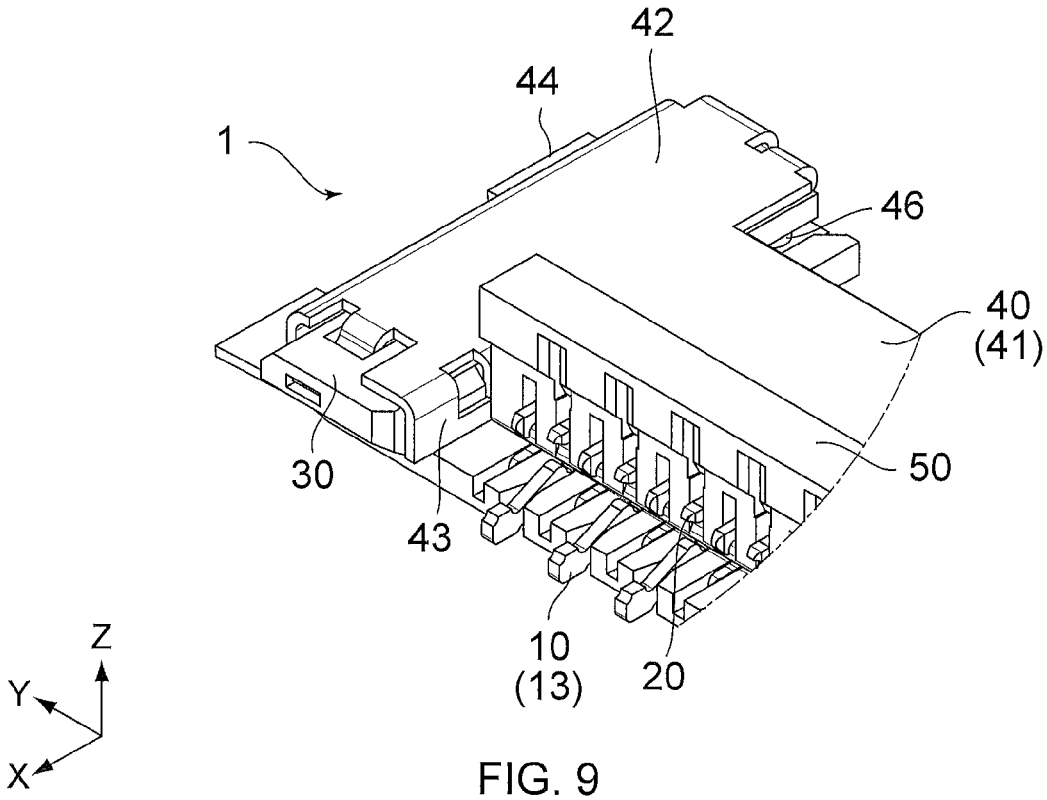
FIG. 9 is a rear, perspective view showing a part of the connector of FIG. 2.

The side portions 42 are positioned at opposite ends of the main plate portion 41 in the width direction. As understood from FIG. 9, the shell connection portions 43 extend downward (in a negative Z-direction) from the side portions 42, respectively. The shell connection portions 43 are positioned rearward of the main plate portion 41.

As shown in FIGS. 1 and 12, each of the holddowns 44 is provided so as to extend continuously from one of the side portions 42. The holddowns 44 are positioned outward of the holding member 30 in the width direction. When the connector is mounted on the object (not shown) such as a circuit board, the holddowns 44 are connected to a ground portion (not shown) which is formed on the object. In other words, when the connector 1 is mounted on the object (not shown), the shell (conductive member) 40 is connected to the ground portion (not shown) which is formed on the object.

Figure 8:
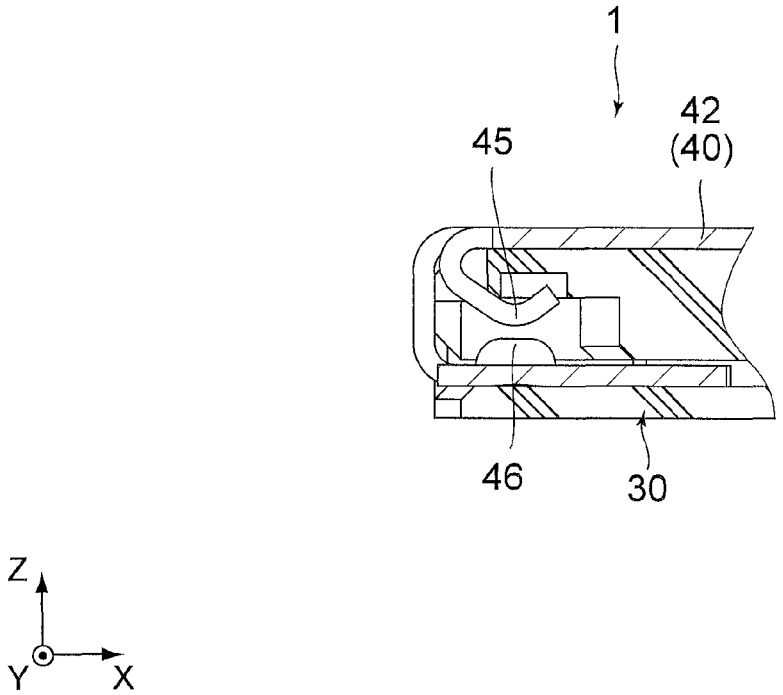
FIG. 8 is a cross-sectional view showing a part of the connector of FIG. 3, taken along line VIII-VIII.

The upper connection portions 45 and the lower connection portions 46 are provided so as to extend continuously from the side portions 42, respectively. The upper connection portions 45 face the lower connection portions 46, respectively, in the up-down direction. The upper connection portions 45 and the lower connection portions 46 are positioned frontward of the main plate portion 41. As understood from FIG. 5, the upper connection portions 45 and the lower connection portions 46 are positioned frontward of the upper contact points 11, 21 and the lower contact points 12, 22, and are positioned outward of the upper contact points 11, 21 and the lower contact points 12, 22 in the width direction. Furthermore, the upper connection portions 45 and the lower connection portions 46 are positioned frontward of the rotation preventing portions 32. In other words, the rotation preventing portions 32 are positioned rearward of the upper connection portions 45 and the lower connection portions 46. As understood from FIGS. 8 and 13, the upper connection portions 45 are spring portions while the lower connection portions 46 are protruding portions.

As understood from FIGS. 5, 15 and 17, when the FPC 80 is inserted into the receiving portion 6, either the upper connection portions 45 or the lower connection portions 46 are in contact with the exposed portions 88 of the ground pattern 86, respectively. In detail, when the FPC 80 is inserted into the receiving portion 6 so that the exposed portions 88 face downward, the exposed portions 88 are in contact with the lower connection portions 46, respectively. On the other hand, when the FPC 80 is inserted into the receiving portion 6 so that the exposed portions 88 face upward, the exposed portions 88 are in contact with the upper connection portions 45, respectively. In both cases, the exposed portions 88 can be sufficiently connected by using spring forces of the upper connection portions 45.

Figure 2:
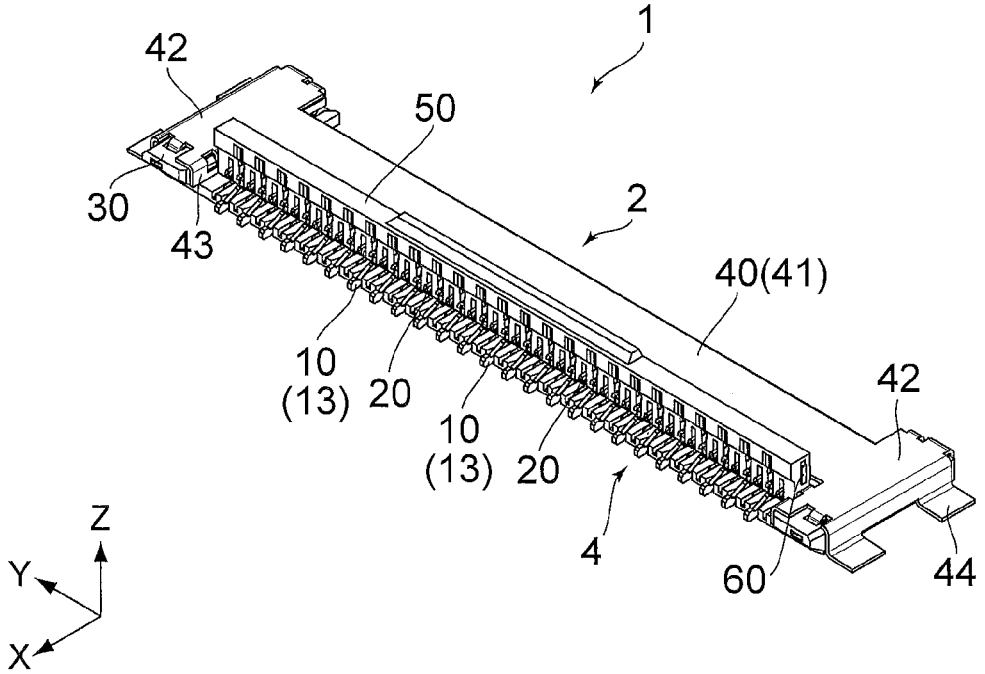
FIG. 2 is a rear, perspective view showing the connector of FIG. 1.
Figure 3:
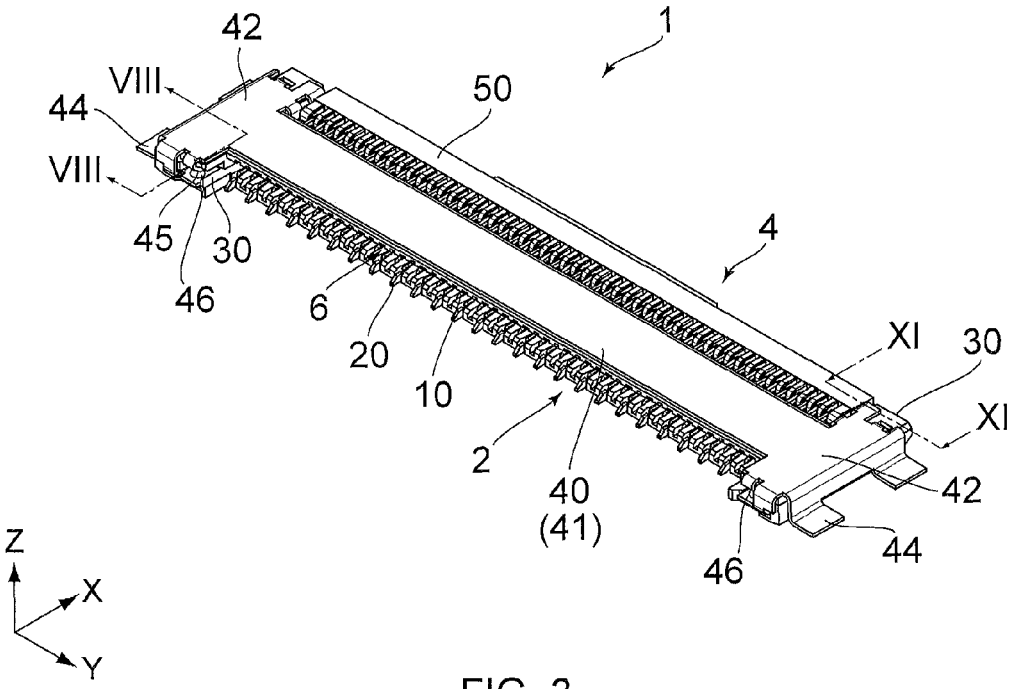
FIG. 3 is another front, perspective view showing the connector of FIG. 1. The illustrated actuator is under a close state.
Figure 4:
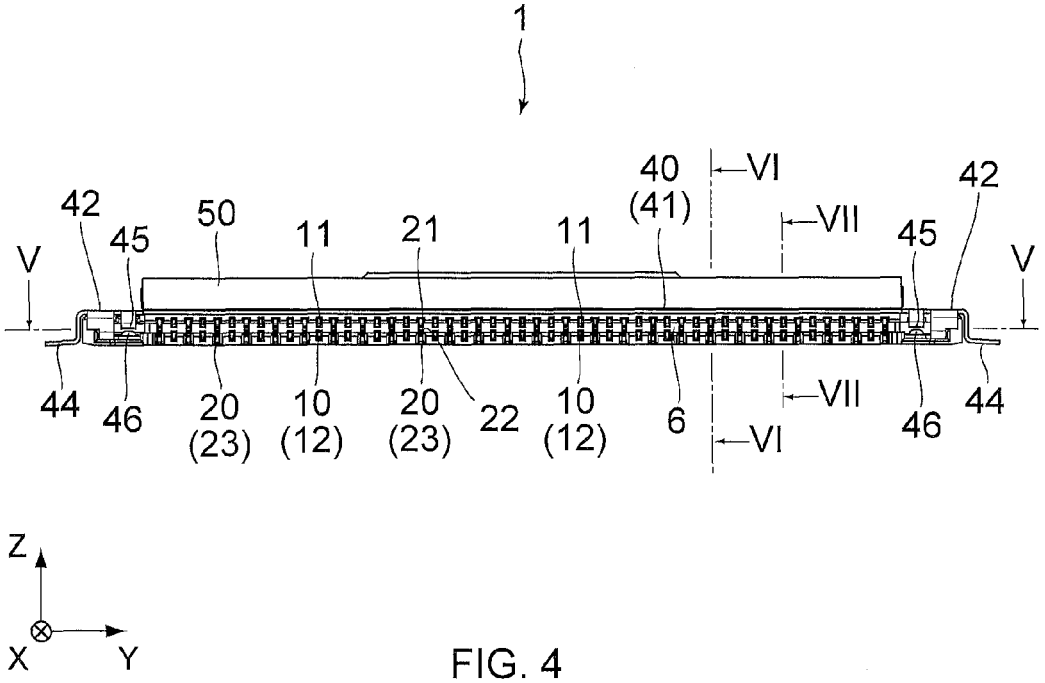
FIG. 4 is a front view showing the connector of FIG. 1.

As understood from FIGS. 1 to 3, the actuator 50 is supported by the holding member 30 to be selectively takable an open state or a close state. As shown in FIGS. 6 and 7, the actuator 50 is provided with cams 51. When the actuator 50 is under the open state, the cams 51 apply only little forces to the first contacts 10 and the second contacts 20. Accordingly, the end 82 of the FPC 80 can be easily received in the receiving portion 6 of the connector 1. In contrast, when the actuator 50 is under the close state, the cams 51 apply forces to the first contacts 10 and the second contacts 20 to reduce distances between upper contact points 11, 21 and the lower contact points 12, 22. Accordingly, when the end 82 of the FPC 80 is received in the receiving portion 6, either the upper contact points 11, 21 or the lower contact points 12, 22 are pressed on the terminals 83 of the FPC 80, respectively, so that their connections are secured. Especially, the connector 1 according to the present embodiment is a back-flip type connector. As understood from FIGS. 1 to 3, the actuator 50 is under the close state when the actuator 50 is turned rearward.

Figure 10:
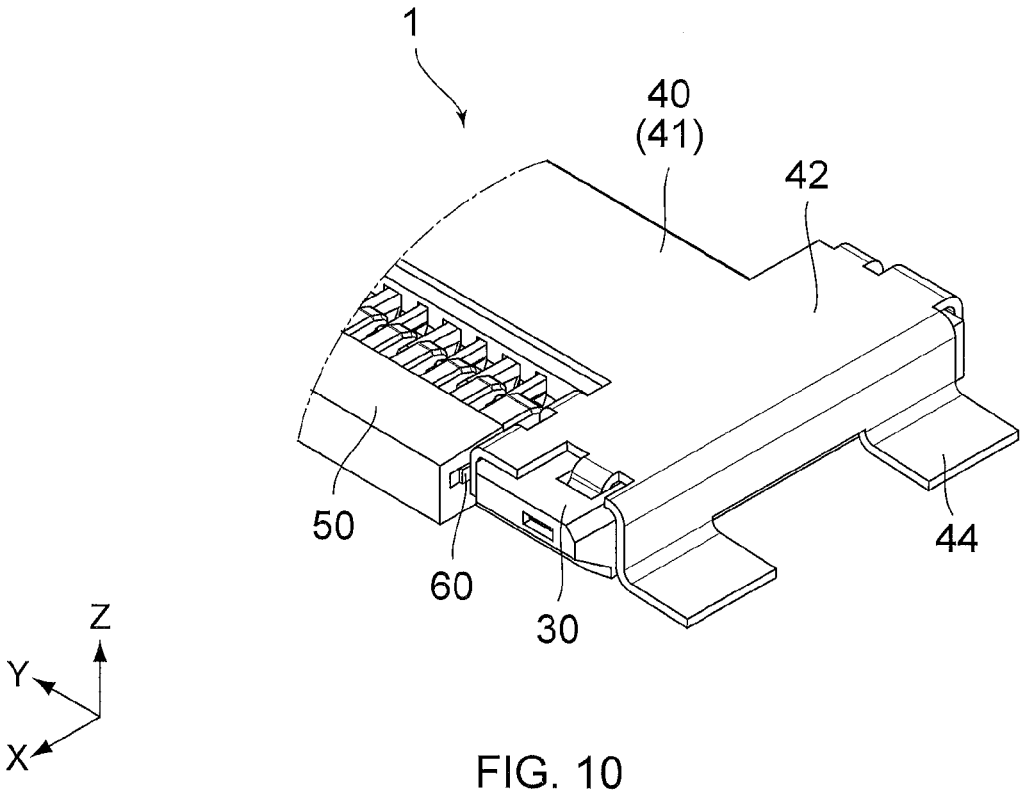
FIG. 10 is a rear, perspective view showing a part of the connector of FIG. 3.
Figure 11:
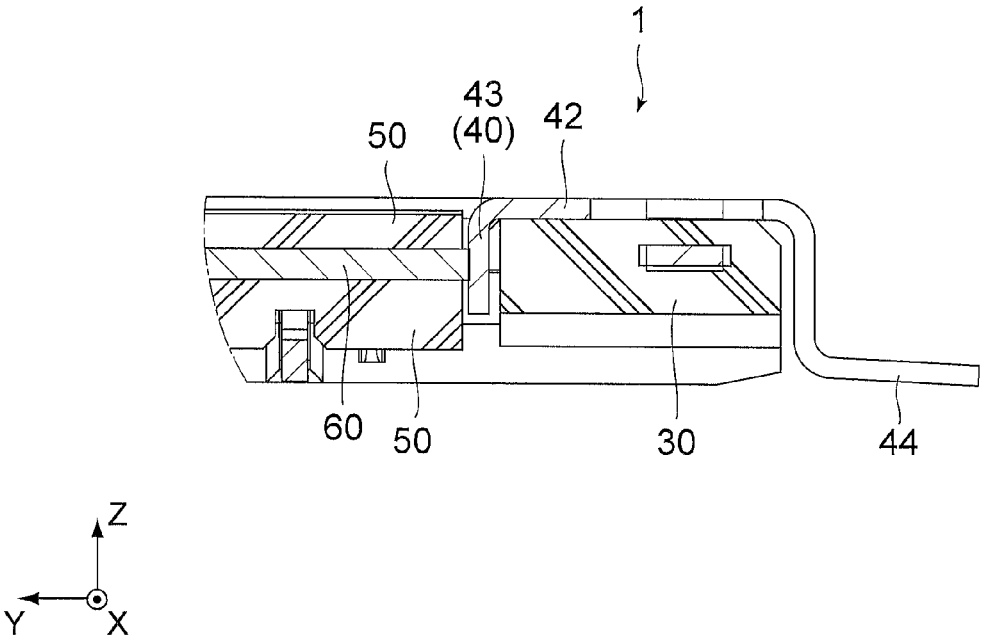
FIG. 11 is a cross-sectional view showing a part of the connector of FIG. 3, taken along line XI-XI.

As shown in FIGS. 6, 7 and 11, the shield member 60 is embedded in the actuator 50. The illustrated shield member 60 is formed of an elongated metal plate and is positioned upward (positive Z-direction) of the fixed portion 13 of the first contacts 10 when the actuator 50 is under the close state. As understood from FIGS. 9 to 11, when the actuator 50 is under the close state, the shield member 60 is connected to the shell connection portions 43 of the shell 40. In other words, when the actuator 50 is under the close state, the shield member 60 is connected through the shell 40 to the ground portion of the object (not shown) on which the connector 1 is mounted. Accordingly, the fixed portions 13 of the first contacts 10 are electromagnetically protected by the shield member 60.

When the end 82 of the FPC 80 is inserted into the receiving portion 6 of the connector 1 having the structures as described above, either the lower connection portions 46 or the upper connection portions 45 are connected to the exposed portions 88 of the FPC 80, respectively. Accordingly, the ground pattern 86 is connected to the ground portion of the object (not shown) through the shell 40 so that high shield characteristics can be obtained. Furthermore, when the actuator 50 is turned rearward to be under the close state, either the upper contact points 11, 21 or the lower contact points 12, 22 are connected to the terminals 83, respectively. Specifically, when the actuator 50 is turned rearward after the end 82 of the FPC 80 is inserted into the receiving portion 6 so that the terminals 83 face upward, the lower connection portions 46 are connected to the exposed portions 88 of the FPC 80, respectively, while the upper contact points 11, 21 are connected to the terminals 83 of the FPC 80, respectively. When the actuator 50 is turned rearward after the end 82 of the FPC 80 is inserted into the receiving portion 6 so that the terminals 83 face downward, the upper connection portions 45 are connected to the exposed portions 88 of the FPC 80, respectively, while the lower contact points 12, 22 are connected to the terminals 83 of the FPC 80, respectively. Thus, the connector 1 of the present embodiment is connectable to the FPC 80 having the ground pattern 86 so that a high-speed signal can be transmitted.

As understood from FIG. 18, the upper connection portions 45 and the lower connection portions 46 are positioned outward in a width direction of the ordinary FPC 80A so that a connection between the ordinary FPC 80A and the connector 1 is not inhibited. In other words, the connector 1 according to the present embodiment is connectable to the ordinary FPC 80A having a belt-like shape.

In addition, the upper connection portions 45 and the lower connection portions 46 are positioned outward of the upper contact points 11, 12 and the lower contact points 12, 22 in the width direction and are positioned rearward of the upper contact points 11, 12 and the lower contact points 12, 22. Accordingly, the connector 1 can be provided with the upper connection portions 45 and the lower connection portions 46 without enlarging the connector 1.

Furthermore, the upper connection portions 45 and the lower connection portions 46 are positioned at the above-described positions so that the shell 40 is not necessary to extend over the fixed portions 23 of the second contacts 20. Thus, when the connector 1 is viewed from above, the fixed portions 23 of the second contacts 20 are visible. Specifically, when the fixed portions 23 are connected to an object (not shown) such as a circuit board or the like by soldering, quality of the soldering can be confirmed.

While the connector 1 according to the present embodiment has been described above, the present invention is not limited thereto. Various modifications and applications are possible with the present invention.

In the above-described embodiment, the connection member which is connected to the connector 1 is the FPC 80. Another plate-like or sheet like connection member instead of the FPC 80 may be connected to the connector 1. For example, the connection member may be an FFC.

Although the above-described connector 1 comprises the actuator 50, the present invention is applicable to a connector which do not have an actuator.

Furthermore, although the above-described connector 1 is a back-flip type connector in which the actuator 50 is turned rearward to take the close state, the present invention is applicable to a front-flip type connector. Rather than the front-flip type connector 1, the back-flip type connector 1 can adopt a constitution in which the main plate portion 41 of the shell 40 covers almost all the holding member 30. Accordingly, the back-flip type connector 1 is preferable as the connector 1 if the connector 1 is required to have high shield characteristic.

Although the above-described shell 40 covers almost all the holding member 30, holddown members may be attached to opposite ends of the holding member, respectively, if the connector is not required to have high shield characteristic. The holddown members include the side portions 42, the holddowns 44 and the like, respectively. The holddown members have structures obtained by omitting the main plate portion 41. In that case, the upper connection portions 45 and the lower connection portions 46 are provided on the holddown members, respectively.

Although the above-described connector 1 comprises two kinds of contacts, i.e. the first contacts 10 and the second contacts 20, the connector 1 may comprise only the first contacts 10 or the second contacts 20. To narrow pitches between contacts, it is preferable that the connector 1 comprises two kinds of contacts: the first contacts 10 and the second contacts 20.

Although the above-described connector 1 comprises the shield member 60, the shield member 60 may be omitted if the connector 1 does not have the first contacts 10 or if the connector 1 is not required to have high shield characteristic.

The above-described connector 1 comprises the upper contact points 11, 12, the lower contact points 12, 22, the upper connection portions 45, and the lower connection portions 46 in order that the connector 1 is connectable to the FPC 80 which is reversely inserted into the connector 1. If the connector 1 is not required to connectable to the FPC 80 which is reversely inserted into the connector 1, the connector 1 may comprise only ones of the upper contact points 11, 21 and the lower contact points 12, 22 and may comprise only ones of the upper connection portions 45 and the lower connection portions 46.

Although the upper connection portions 45 and the lower connection portions 46 are the spring portions and the protruding portions, respectively, in the above-described embodiment, the upper connection portions 45 and the lower connection portions 46 may be the protruding portions and the spring portions, respectively. Both the upper connection portions 45 and the lower connection portions 46 may be the spring portions.

In addition, if the connector 1 is not required to connectable to the FPC 80 which is reversely inserted into the connector 1, the upper connection portions 45 or the lower connection portions 46 may be the spring portions to be in contact with the exposed portions 88, respectively, and remaining portions may have flat faces, respectively.

Although the above-described rotation preventing portions 32 are formed as parts of the holding member 30, respectively, the rotation preventing portions 32 may be formed by members other than the parts of the holding member 30. In addition, the rotation preventing portions 32 are omitted if a rotation of the FPC 80 is restricted by any other means.

As shown in FIG. 16, the above-described FPC 80 comprises one signal layer 90. For example, the FPC 80 may comprise two signal layers.

Although the exposed portions 88 of the above-described FPC 80 are formed on a back of a surface on which the terminals 83 are formed, the exposed portions 88 and the terminals 83 may be formed on a common surface.

The present application is based on a Japanese patent application of JP2013-221730 filed before the Japan Patent Office on Oct. 25, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector having a receiving portion which receives a connection member inserted rearward in a front-rear direction, wherein:

the connection member has a plate-like or sheet-like shape and has terminals and a ground pattern;

the connector comprises a plurality of contacts, a holding member and a conductive member;

the contacts have contact points, respectively;

the contact points are to be in contact with the terminals, respectively;

the holding member holds the contacts;

the conductive member is attached to the holding member;

the conductive member has a shield connection portion which is to be in contact with the ground pattern;

the shield connection portion is positioned frontward of the contact points of the contacts in the front-rear direction and is positioned outward of the contact points in a width direction perpendicular to the front-rear direction;

the connector comprises a shell;

the shell is made of a conductor and covers, at least in part, the holding member;

the shell functions as the conductive member;

the shield connection portion is formed as a part of the shell;

the connector further comprises an actuator;

the actuator is supported by the holding member so that the actuator selectively takes an open state or a close state; and when the actuator is turned rearward, the actuator takes the close state while the actuator causes the contact points of the contacts to be connected with the terminals of the connection member, respectively; and a shield member is made of a metal and is embedded in the actuator.

2. The connector as recited in claim 1, wherein:

the connector further comprises an actuator;

the actuator is supported by the holding member so that the actuator selectively takes the open state or the close state; and when the actuator is under the close state, the actuator causes the contact points of the contacts to be connected with the terminals of the connection member, respectively.

3. The connector as recited in claim 1, wherein the shield member is connected to the conductive member when the actuator is under the close state.

4. The connector as recited in claim 1, wherein:

the connector is mounted on an object;

the conductive member is connected to a ground portion; and the ground portion is formed on the object.

5. The connector as recited in claim 4, wherein:

the conductive member has a holddown;

the holddown is connected to the ground portion; and the holddown is positioned outward of the holding member in the width direction.

6. A connection member comprising a signal layer, a ground layer, a first insulation layer, a second insulation layer and a third insulation layer, wherein:

the connection member has a-plate-like or sheet-like shape;

the first insulation layer is sandwiched between the signal layer and the ground layer;

the signal layer is sandwiched between the first insulation layer and the second insulation layer;

the signal layer is formed with terminals and signal lines;

the signal lines are connected to the terminals, respectively;

the terminals are positioned in the vicinity of an end in a lengthwise direction of the connection member;

the signal lines extend away from the end of the connection member;

the ground layer is sandwiched between the first insulation layer and the third insulation layer;

the ground layer is formed with a ground pattern; and the ground pattern is exposed at a position which is farther away from the end of the connection member than the terminals in the lengthwise direction and is located outward of the terminals in a width direction perpendicular to the lengthwise direction.

7. A connector having a receiving portion which receives a connection member inserted rearward in a front-rear direction, wherein:

the connection member has a plate-like or sheet-like shape and has terminals and a ground pattern;

the connector comprises a plurality of contacts, a holding member and a conductive member;

the contacts have contact points, respectively;

the contacts are to be in contact with the terminals, respectively;

the holding member holds the contacts;

the conductive member is attached to the holding member;

the conductive member has a shield connection portion which is to be in contact with the ground pattern;

the shield connection portion is positioned frontward of the contact points of the contacts in the front-rear direction and is positioned outward of the contact points in a width direction perpendicular to the front-rear direction;

the contacts have upper contact points and lower contact points, respectively;

the upper contact points face the lower contact points, respectively, in an up-down direction perpendicular to both the front-rear direction and the width direction;

when the connection member is inserted into the receiving portion so that the terminals face upward, the upper contact points function as the contact points, respectively, and are in contact with the terminals;

when the connection member is inserted into the receiving portion so that the terminals face downward, the lower contact points function as the contact points, respectively, and are in contact with the terminals;

the conductive member has an upper connection portion and a lower connection portion;

the upper connection portion faces the lower connection portion in the up-down direction;

when the connection member is inserted into the receiving portion so that the ground pattern faces upward, the upper connection portion functions as the shield connection portion and is in contact with the ground pattern; and when the connection member is inserted into the receiving portion so that the ground pattern faces downward, the lower connection portion functions as the shield connection portion and is in contact with the ground pattern.

8. The connector as recited in claim 7, wherein:

the connector comprises a shell;

the shell is made of a conductor and covers, at least in part, the holding member;

the shell functions as the conductive member; and the shield connection portion is formed as a part of the shell.

9. The connector as recited in claim 8, wherein:

the connector further comprises an actuator;

the actuator is supported by the holding member so that the actuator selectively takes an open state or a close state; and when the actuator is turned rearward, the actuator takes the close state while the actuator causes the contact points of the contacts to be connected with the terminals of the connection member, respectively.

10. The connector as recited in claim 7, wherein one of the upper connection portion and the lower connection portion is a spring portion, and a remaining one of the upper connection portion and the lower connection portion is a protruding portion.

11. A connector having a receiving portion which receives a connection member inserted rearward in a front-rear direction, wherein:

the connection member has a plate-like or sheet-like shape and has terminals and a ground pattern;

the connector comprises a plurality of contacts, a holding member and a conductive member;

the contacts have contact points, respectively;

the contact points are to be in contact with the terminals, respectively;

the holding member holds the contacts;

the conductive member is attached to the holding member;

the conductive member has a shield connection portion which is to be in contact with the ground pattern;

the shield connection portion is positioned frontward of the contact points of the contacts in the front-rear direction and is positioned outward of the contact points in a width direction perpendicular to the front-rear direction;

the holding member has a rotation preventing portion which prevents the connection member from rotating and moving in a plane defined by the front-rear direction and the width direction; and the rotation preventing portion is positioned outward of the contact points of the contacts in the width direction and is positioned rearward of the shield connection portion in the front-rear direction.

12. A connector having a receiving portion which receives a connection member inserted rearward in a front-rear direction, wherein:

the connection member has a plate-like or sheet-like shape and has terminals and a ground pattern;

the connector comprises a plurality of contacts, a holding member and a conductive member;

the contacts have contact points, respectively;

the contact points are to be in contact with the terminals, respectively;

the holding member holds the contacts;

the conductive member is attached to the holding member;

the conductive member has a shield connection portion which is to be in contact with the ground pattern;

the shield connection portion is positioned frontward of the contact points of the contacts in the front-rear direction and is positioned outward of the contact points in a width direction perpendicular to the front-rear direction;

the connector is mounted on an object;

the conductive member is connected to a ground portion; and the ground portion is formed on the object;

the contacts have fixed portions, respectively;

the fixed portions are fixed on the object;

the contacts include at least one front contact which has the fixed portion positioned frontward of the contact point in the front-rear direction; and the fixed portion of the front contact is visible when the connector is viewed from above in an up-down direction perpendicular to both the front-rear direction and the width direction.

* * * * *